United States Patent [19]

Burke et al.

[11] 4,211,010

[45] Jul. 8, 1980

[54] MULTIPLE-CURVED FASHION DESIGN TOOL

[76] Inventors: Roger W. Burke, 200 SW. Market St., Suite 961, Portland, Oreg. 97201; Sheila T. Boone, 1129 SE. 34th, Portland, Oreg. 97204

[21] Appl. No.: 930,897

[22] Filed: Aug. 4, 1978

[51] Int. Cl.[2] ..... A41H 1/00

[52] U.S. Cl. ..... 33/11; 33/177

[58] Field of Search ..... 33/11, 17 R, 2 R, 75 R, 33/177, 17 A

[56] References Cited

U.S. PATENT DOCUMENTS

| | | | |
|---|---|---|---|
| 269,652 | 12/1882 | Ferguson | 33/11 |
| 514,063 | 2/1894 | Call | 33/11 |
| 535,843 | 3/1895 | Marshall | 33/11 |
| 1,158,425 | 11/1915 | Barnes | 33/11 |

OTHER PUBLICATIONS

"Designer Workbook II", by Rodger William Burice, International Fashion Institute, 1977. 4n 30 Figures A.10, A.11 and A.12 from "Pants and Skirts", by Jan Minott, Burgess Publishing Co., Second Ed., 1974.

*Primary Examiner*—Willis Little

*Attorney, Agent, or Firm*—Poms, Smith, Lande & Rose

[57] ABSTRACT

A multiple-curved fashion design tool of substantially transparent colored plastic material for fashioning and tailoring both ready-made and home-sewn clothing. Adjoining one-by-one inch grids with ⅛" divisions are formed in each major surface of the tool and are disposed thereon so as to encompass the entire periphery of the tool. Each of the unique curved and straight edge portions of the tool are especially adapted for and combine with the continuous grid to permit the tool to be readily useful in a wide range of fashioning and tailoring applications.

6 Claims, 4 Drawing Figures

MULTIPLE-CURVED FASHION DESIGN TOOL

BACKGROUND AND SUMMARY OF THE INVENTION

The present invention relates generally to the preparation of both home-sewn and ready-made clothing and more particulary relates to the adaptation of articles of clothing to the particular anatomical contours and configurations of a specific subject for achieving a proper and flattering fit.

A significant short coming of known processes for producing articles of clothing has heretofore centered on a failure to adequately resolve the competing factors of providing proper and flattering fits irrespective of the wide variety in individual anatomical contours and configurations while simultaneously achieving maximum economies of mass production. A compromise is ordinarily drawn between these competing considerations by providing each article in a variety of sizes and in some cases with variations of sleeve lengths, collar sizes and the like within each particular size. Other attempts to alleviate this difficulty includes adopting frequently experienced particular curvatures and angular adjustments for particular articles which are designed to achieve optimum fits for a broader number of persons and thereafter providing individual tailoring following the purchase of a particular article.

The above-described solution approximations have heretofore resulted in requiring clothes designers and tailors to purchase and maintain large inventories of tailoring and pattern tools. It is particularly significant in this regard to note that although various types of straight, curved and combinations of both straight and curved surfaced tools, including sundry pattern drafting tools have been heretofore presented, no known tool has ever been advanced which embraces all of the angles, lineations and curvatures needed to properly make and adjust clothing patterns. This aspect of the difficulty is particularly acute for in-home preparers of home-sewn clothing since it is believed that the onerous burden of acquiring and maintaining large inventories of tailoring tools coupled with the complexities attendant using same foreclose this avenue of self-help to a significantly large group of clothing consumers.

The present invention alleviates many of the above-described deficiencies by providing a multiple-curved styling and tailoring tool of substantially transparent colored plastic material which not only is believed to encompass every straight, curved and angular surface needed to properly draft or adjust a clothing pattern; but, also is both relatively uncomplex in its applications and readily manufacturable thereby being relatively inexpensive to produce.

In its preferred embodiment the tool is an elongate curved article having a length of about 30 inches, a maximum width of about 5 inches, a thickness of about 80 mm, a substantially semi-circular curved end and a relatively straight end.

In particular, each major face of the elongate tool is provided with: a relatively linear end; a top surface which is substantially linear for a majority of its length beginning at the linear end and thereafter describes an upward arc (herein called the inside curvature); and a bottom surface (herein called the outside curvature) which curves downwardly from the linear end for about one-half of its length and thereafter curves upwardly until the tool obtains a maximum length thence converging with the top surface so as to provide the tool with a substantially semi-circular end.

It is especially important to note that the present tool has means defining a continuous grid substantially all around the periphery of each of its major faces, the grids comprising a plurality of adjoining one inch squares with each square containing 64 one-eighth inch squares, it being understood that certain squares undergo some distortion relating to the curved areas of the tool.

Yet further features, advantages and objectives of the invention will become apparent, and the full nature of the invention will be more readily understood from the accompanying drawings and the following descriptions and claims.

DETAILED DESCRIPTION OF THE INVENTION

Figures 1, 2, 3:
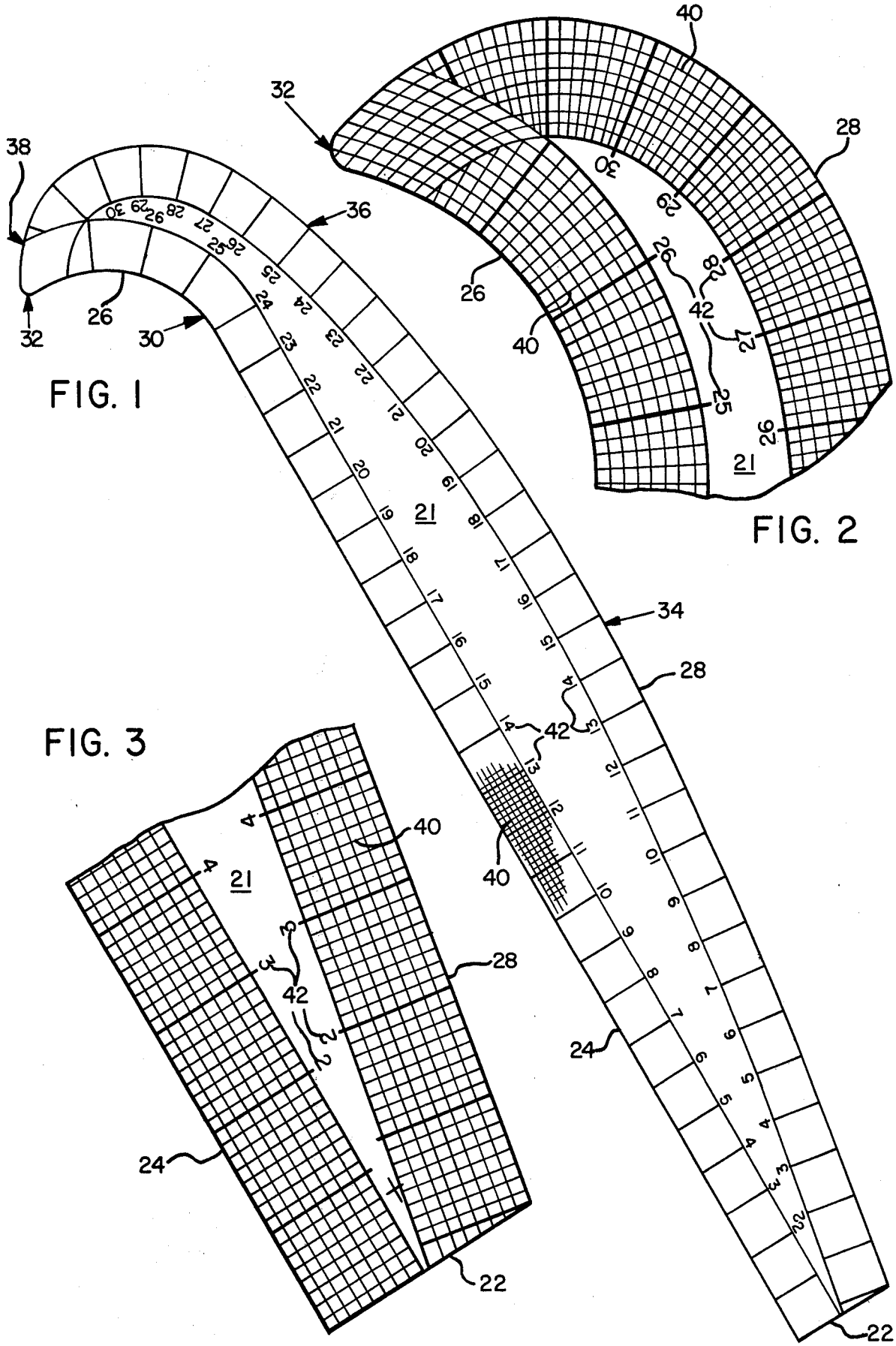
FIG. 1 is a top plan view of one major face of an exemplary embodiment of the present tool.
FIGS. 2 and 3 are expanded views of a portion of the tool of FIG. 1 illustrating the continuous grid thereof.

Referring now particularly to FIGS. 1 and 2 of the drawings, an exemplary embodiment of the present invention is shown wherein numeral 20 refers generally to a multiple-curved fashion design tool, hereinafter called tool 20.

Tool 20 has an elongate configuration including both straight and curved peripheral surfaces, a first major face 21 and a second major face (not shown) constituting substantially a mirror image of the first major face. Tool 20 can be of any suitable material which provides the desired degree of rigidity or flexibility and durability. In the preferred embodiment, however, tool 20 is of a durable substantially transparent plastic material such as 80 mm DB Lucite, tinted in a pastel hue for providing a durable, relatively rigid tool which is esthetically attractive and can be readily manufactured.

More particularly, tool 20 has an irregular elongate outer configuration with each corresponding major face 21 including a substantially linear end 22, an upper linear edge 24, an inside curvature 26 and an outside curvature 28. The overall dimensions of tool 20 are ordinarily established by its principal intended environment and range from being relatively small for doll clothing to relatively large for "oversize" clothing.

At the top of each major face 21, tool 20 is relatively straight from the top of its linear end 22 to a first position 30 spaced about 24 inches (60 cm) therefrom (thereby defining upper linear edge 24) and thereafter undergoes a gentle upward curve so as to be vertically offset from the straight portion by about 3 inches (7.6 cm) at a second position 32 longitudinally displaced from the straight end by about 26.6 inches (66 cm) thereby defining the inside curvature 26.

Conversely, at the bottom of each major face 21, the tool 20 undergoes a gentle downward curve beginning at the bottom of its linear end 22 and continuing to a third position 34 longitudinally displaced from the linear end by about 15 inches (38 cm) such that the tool 20 has a width of about 2 inches (6.6 cm) at its linear end and a width of about 4 inches (13.2 cm) at the third position thereby defining the outside curvature 28.

From proximate the third position 34 to a fourth position 36, corresponding to the second position and also longitudinally displaced from the linear end 22 by about 26.6 inches (66 cm), tool 20 undergoes a gentle upward curve such that it has a width at the fourth position (and also at the second position 32) of about 5 inches (12.5 cm) with the fourth position being vertically displaced from the third position by about 2 inches (6.6 cm).

From proximate the fourth position 36, the tool 20 undergoes a rapid upward curve so as to obtain a maximum length at a fifth position 38 longitudinally displaced from the linear end 22 by about 28.6 inches (73 cm) and thereafter curves such as to substantially converge with the top surface at the third (and second) position thereby providing tool 20 with the outside curvature 28.

Figure 4:
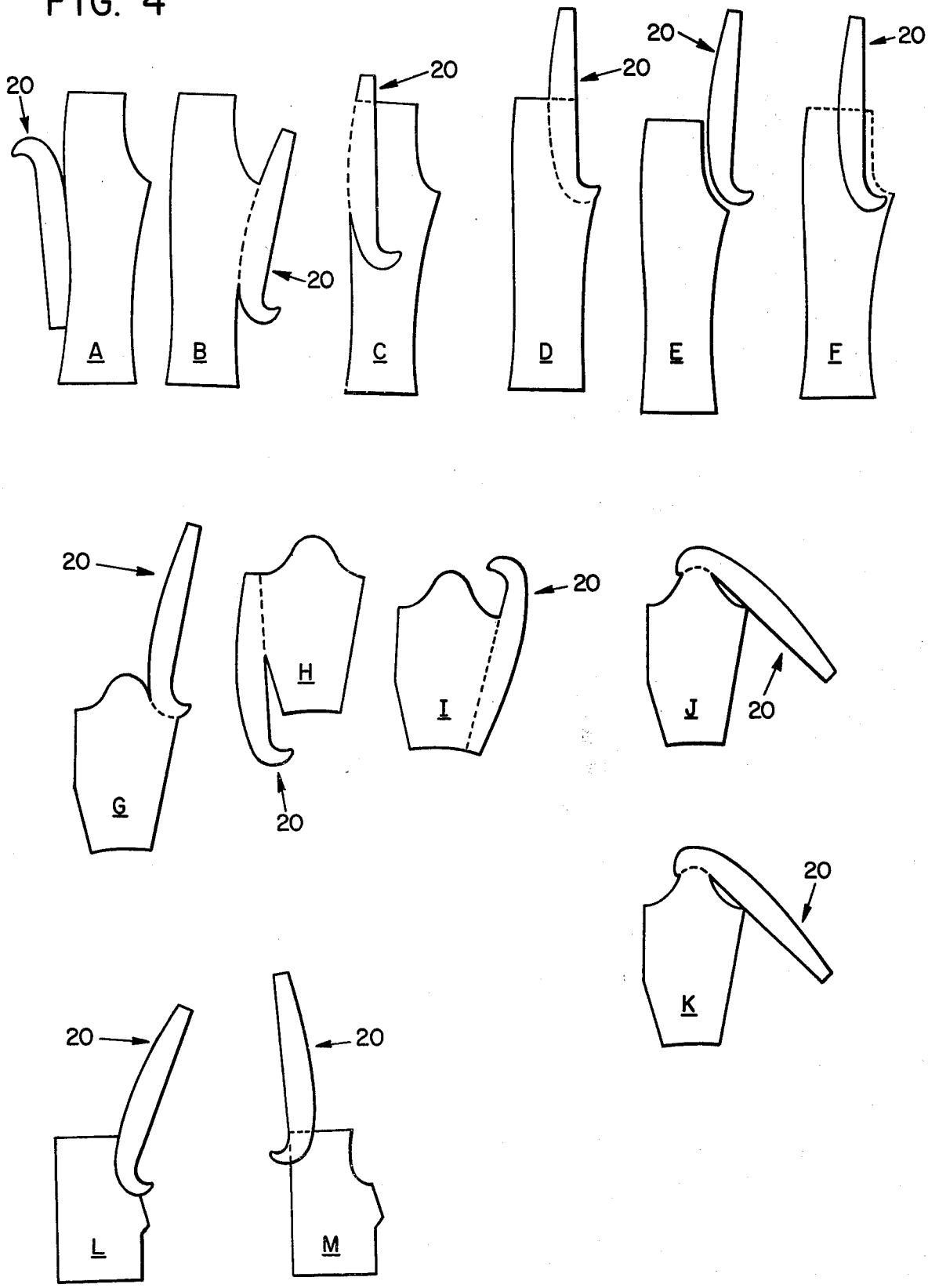
FIGS. 4 A–M is a sequence of top plan views depicting some of the applications for the tool of FIG. 1.

By arranging a grid pattern 40 and associated numerical indices 42 on, preferably, both of the major faces 21 of tool 20, as shown in FIGS. 4 A–M, significantly enhanced placement and measurement versatility is achieved permitting use of the tool in an extremely wide range of applications in fashioning and tailoring both ready-made and home-sewn clothing. These grid pattern and indices, according to the tool material, may comprise labels, printing or any suitable medium; but, preferably are formed in tool 20 such as to be integral thereto for withstanding cyclical repeated use without dimunition.

As best seen in FIG. 2, in its preferred embodiment, tool 20 has means defining the grid 40 and numerical indices 42 associated therewith substantially all around the periphery of each of its major faces 21, the grids comprising a plurality of adjoining one inch (2.54 cm) squares with each square containing 64 one-eighth inch (0.4 cm) squares, it being understood that certain squares are somewhat distorted in the curved areas of tool 20.

Tool 20 is used for measuring purposes as well as for drafting and correcting commercial patterns as illustrated in FIGS. 3 A–M. It is especially useful for establishing seam lines (additions to stitching lines) on all angles of the pattern. In this aspect, the one-eighth inch (0.4 cm) squares all around its perimeter lend themselves to adding seam allowances. The individual is thus able to use the grid areas of the curve to make seam extensions for crotch areas on pants, sleeve caps, armholes, collars, cuffs, zippers and the like.

The area denoted by numerical indices "18–33" on the outside curvature 28 are useful for: designing armholes, measuring the armhole depth, changing a commercial pattern in dimension or in design and the like, especially during initial drafts of a pattern for sleeves, armholes and crotches on pants. In a similar vein the area denoted by numerical indices "0–26" on the outside curvature 28 is used for: designing hip lines on skirts and pants; designing bodice patterns such as in a dress shirt, blouse or jacket; and, correcting commercial patterns in the hip, pant-leg and bodice area. The entire outside curvature is used for developing "princess line" garments.

The area denoted by numerical indices "18–33" on the inside curvature 26 is used for: designing collars and cuffs; adjusting necklines and lapels; and adjusting seam allowances on collars, cuffs, necklines and the crotch of a pant. Because of its substantially transparency, seam allowances can be added in all angles where there are curvatures as well as straight lines. Yet further uses for tool 20 are believed to be available.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A multiple-curved fashion design tool for adapting both ready-made and home-sewn articles of clothing to particular contours and configurations of a particular subject comprising:

(a) an article of substantially transparent plastic material having an irregular elongate outer configuration, a predetermined thickness and opposing major faces;

(b) each major face being characterized by having a substantially linear end, an upper perimeter being substantially linear for substantially two-thirds its length beginning at the linear end, and thereafter curing upwardly for the remainder of its length thereby defining an inner curvature, and a lower perimeter which curves outwardly downward from the linear end for substantially about one-half its length, thereafter curves inwardly until it reaches the maximum tool length and thence defines an arc one end of which substantially converges with the upper perimeter thereby defining an outer curvature and providing the tool with an approximated substantially semi-circular end;

(c) means defining regularly spaced apart numerical indices at predetermined locations arranged substantially all along both the upper and lower perimeters of each major face thereby defining means for performing linear measurements with the tool; and (d) means defining thereon a grid pattern correlated to said numerical indices, the grid pattern extending substantially all along the upper and lower perimeters of each major faces.

2. The multiple-curved fashion design tool of claim 1 wherein;

the top of each major face of the tool is relatively straight from the top of its linear end to a first position spaced about 24 inches therefrom, thereby defining said upper linear edge, and thereafter undergoes a gentle upper curve so as to be vertically off set from the straight portion by about 3 inches at a second position longitudinally displaced from the straight end by about 26.6 inches, thereby defining said inside curve.

3. The multiple-curved fashion design tool of claim 2 wherein:

at the bottom of each major face, the tool undergoes a gentle downward curve beginning at the bottom of its linear end and continuing to a third position longitudinally displaced from the linear end by about 15 inches such that the tool has a width of about 2 inches at its linear end and a width of about 4 inches at the third position, thereby defining said outside curvature.

4. The multiple-curved fashion design tool of claim 3 wherein said tool undergoes a gentle upward curve from proximate said third position to a fourth position longitudinally displaced from said linear end by about 26.6 inches such that the tool width at said fourth position is about 5 inches with the fourth position being vertically displaced from the third position by about 2 inches.

5. The multiple-curved fashion design tool of claim 4 wherein:

the outer configuration of said tool undergoes a rapid upper curve from proximate said fourth position so as obtain a maximum length at a fifth position longitudinally displaced from the linear end by about 28.6 inches and thereafter curves such as to substantially converge with the top at the second position thereby providing said outside curvature.

6. A multiple-curved fashion design tool for adapting both ready-made and home-sewn articles of clothing to particular contours and configurations of a particular subject comprising:

(a) an article of substantially transparent plastic material having an irregular elongate configuration, a predetermined thickness and opposing major faces;

(b) each major face being characterized by having a substantially linear end, an upper perimeter being substantially linear for substantially two-thirds its length beginning at the linear end and continuing to a first position, and thereafter curving upwardly for the remainder of its length to a second position thereby defining an inner curvature, and a lower perimeter which curves outwardly downward from the linear end for substantially about one-half its length to a third position, thereafter curves inwardly upward until it reaches a fourth position and thence undergoes a rapid upward curve to a fifth position at the maximum tool length, and then continues in an arc one end of which substantially converges with the upper perimeter at said second position thereby defining an outer curvature and providing the tool with an approximated substantially semi-circular end;

(c) means defining regularly spaced apart numerical indices at predetermined locations arranged substantially all along both the upper and lower perimeters of each major face thereby defining means for performing linear measurements with the tool; and (d) means defining thereon a grid pattern correlated to said numerical indices, the grid pattern extending substantially all along the upper and lower perimeters of each major face.

* * * * *